US009512732B2

(12) United States Patent
Potter et al.

(10) Patent No.: US 9,512,732 B2
(45) Date of Patent: Dec. 6, 2016

(54) LOCKING SPACER ASSEMBLY INSERTED BETWEEN ROTOR BLADES

(71) Applicant: General Electric Company, Schenectady, NY (US)

(72) Inventors: Brian Denver Potter, Greer, SC (US); Michael James Healy, Greenville, SC (US); Christian Michael Hansen, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 529 days.

(21) Appl. No.: 14/055,091

(22) Filed: Oct. 16, 2013

(65) Prior Publication Data

US 2015/0101347 A1 Apr. 16, 2015

(51) Int. Cl.
*F01D 5/32* (2006.01)
*F01D 5/30* (2006.01)

(52) U.S. Cl.
CPC ..... *F01D 5/323* (2013.01); *F01D 5/3038* (2013.01); *F01D 5/3053* (2013.01); *F01D 5/32* (2013.01); *F05D 2240/80* (2013.01); *F05D 2260/30* (2013.01)

(58) Field of Classification Search
CPC ..... F01D 5/3007; F01D 5/3023; F01D 5/303; F01D 5/3038; F01D 5/3053; F01D 5/32; F01D 5/323; F01D 5/326; F04D 29/322; F04D 29/34; F05D 2240/24; F05D 2240/80; F05D 2260/30; F02C 3/04
See application file for complete search history.

(56) References Cited

U.S. PATENT DOCUMENTS

| | | | | |
|---|---|---|---|---|
| 2,857,134 | A * | 10/1958 | Arkless | F01D 5/30 416/216 |
| 3,627,448 | A | 12/1971 | Rupp | |
| 3,721,506 | A * | 3/1973 | Anderson | F01D 5/3038 411/433 |
| 4,684,325 | A | 8/1987 | Arnold | |
| 4,859,149 | A | 8/1989 | McClain | |
| H1258 | H | 12/1993 | Hindle, Jr. | |
| 6,135,717 | A | 10/2000 | Sokol et al. | |
| 6,638,006 | B2 | 10/2003 | Selby | |
| 6,929,453 | B2 | 8/2005 | Kite | |
| 7,114,927 | B2 | 10/2006 | Bachofner | |
| 7,435,055 | B2 | 10/2008 | Hansen | |
| 7,581,931 | B2 | 9/2009 | Shaefer | |

(Continued)

*Primary Examiner* — Phutthiwat Wongwian
*Assistant Examiner* — Marc Amar
(74) *Attorney, Agent, or Firm* — Dority & Manning, PA

(57) ABSTRACT

A locking spacer assembly for securing adjacent rotor blades includes a first end piece having a platform portion and a root portion that define an angled first inner surface of the first end piece. The root portion defines a first projection adapted to project into a recess portion of the attachment slot. A second end piece fits between the first inner surface and a sidewall portion of the attachment slot and includes a platform portion and a root portion that define a second projection adapted to project into a recess portion of the attachment slot. The platform portion and the root portion define an angled second inner surface and that is configured to mate with the first inner surface. A borehole extends through the platform portion of the first end piece and the root portion of the second end piece and a fastener extends through the borehole.

20 Claims, 9 Drawing Sheets

(56) References Cited

U.S. PATENT DOCUMENTS

| | | | | |
|---|---|---|---|---|
| 8,176,598 | B2 | 5/2012 | Casavant et al. | |
| 2001/0022936 | A1 | 9/2001 | Zimmermamm | |
| 2004/0037703 | A1 | 2/2004 | Arinci | |
| 2006/0248900 | A1* | 11/2006 | Suciu | F02C 7/32 60/802 |
| 2007/0280831 | A1 | 12/2007 | Pickens | |
| 2009/0016889 | A1 | 1/2009 | Krutzfeldt et al. | |
| 2011/0110782 | A1 | 5/2011 | Brittingham | |
| 2011/0164983 | A1 | 7/2011 | Garcia-Crespo et al. | |
| 2011/0255978 | A1* | 10/2011 | Potter | F01D 5/3038 416/204 A |
| 2015/0101346 | A1 | 4/2015 | Foster et al. | |
| 2015/0101348 | A1 | 4/2015 | Hansen et al. | |
| 2015/0101349 | A1 | 4/2015 | Hansen et al. | |
| 2015/0101350 | A1 | 4/2015 | Healy et al. | |
| 2015/0101351 | A1 | 4/2015 | Healy et al. | |

* cited by examiner

LOCKING SPACER ASSEMBLY INSERTED BETWEEN ROTOR BLADES

FIELD OF THE INVENTION

The present invention generally involves a turbomachine. More specifically, the invention relates to locking spacer assemblies for securing rotor blades to a rotor disk of the turbomachine.

BACKGROUND OF THE INVENTION

Various turbomachines such as a gas turbine or steam turbine include a shaft, multiple rotor disks coupled to the shaft and various rotor blades mounted to the rotor disks. A conventional gas turbine includes a rotatable shaft with various rotor blades mounted to discs in the compressor and turbine sections thereof. Each rotor blade includes an airfoil over which pressurized air, combustion gases or other fluids such as steam flows, and a platform at the base of the airfoil that defines a radially inner boundary for the air or fluid flow.

The rotor blades are typically removable, and therefore include a suitable root portion such as a T-type root portion that is configured to engage a complementary attachment slot in the perimeter of the rotor disk. The root may either be an axial-entry root or a circumferential-entry root that engages with corresponding axial or circumferential slots formed in the disk perimeter. A typical root includes a neck of minimum cross sectional area and root protrusions that extend from the root into a pair of lateral recesses located within the attachment slot.

For circumferential roots, a single attachment slot is formed between forward and aft continuous circumferential posts or hoops that extend circumferentially around the entire perimeter of forward and aft faces of the rotor disk. The cross-sectional shape of the circumferential attachment slot includes lateral recesses defined by the forward and aft rotor disk posts or hoops that cooperate with the root protrusions of the rotor blades to radially retain the individual blades during turbine operation.

In the compressor section of a gas turbine, for example, rotor or compressor blades (specifically the root components) are inserted into and around the circumferential slot and rotated approximately ninety degrees to bring the root protrusions of the rotor blades into contact with the lateral recesses to define a complete stage of rotor blades around the circumference of the rotor disks. The rotor blades include platforms at the airfoil base that may be in abutting engagement around the slot. In other embodiments, spacers may be installed in the circumferential slot between adjacent rotor blade platforms. Once all of the blades (and spacers) have been installed, a final remaining space or spaces in the attachment slot is typically filled with a specifically designed spacer assembly, as generally known in the art.

A common technique used to facilitate the insertion of the final spacer assembly into the circumferential slot is to include a non-axi symmetric loading slot in the rotor disc. Various conventional spacer assemblies have been designed to eliminate the need for a loading slot in the rotor disk. However, these assemblies include complex devices. These conventional assemblies are generally difficult to assemble, costly to manufacture and may result in rotor imbalance. Accordingly, there is a need for an improved locking spacer assembly that is relatively easy to assemble within the final space between platforms of adjacent rotor blades of a turbomachine such as compressor and/or turbine rotor blades of a gas turbine.

BRIEF DESCRIPTION OF THE INVENTION

Aspects and advantages of the invention are set forth below in the following description, or may be obvious from the description, or may be learned through practice of the invention.

One embodiment of the present invention is a locking spacer assembly for insertion into a circumferential attachment slot between platforms of adjacent rotor blades. The locking spacer assembly includes a first end piece that is configured to fit into a space between the platforms of the adjacent rotor blades. The first end piece comprises a platform portion and a root portion. The root portion defines a first projection having a profile that is adapted to project into a recess portion of the attachment slot. The platform portion and the root portion define a first inner surface that is angled with respect to a radially extending plane that is perpendicular to an axial centerline of the locking spacer assembly.

A second end piece is configured to fit between the first inner surface and a sidewall portion of the attachment slot. The second end piece includes a platform portion and a root portion. The root portion defines a second projection having a profile that is adapted to project into a recess portion of the attachment slot. The platform portion and the root portion define a second inner surface that is angled with respect to a radially extending plane that is perpendicular to an axial centerline of the locking spacer assembly. The second inner surface is configured to mate with the first inner surface. A borehole extends through the platform portion of the first end piece and the root portion of the second end piece and a fastener extends through the borehole. One end of the fastener is configured to engage with the root portion of the second end piece.

Another embodiment of the present invention is a rotor assembly. The rotor assembly comprises a rotor disk having a forward post and an aft post. The forward and the aft posts at least partially define a continuous circumferentially extending attachment slot. The rotor assembly further includes a plurality of rotor blades. Each of the plurality of rotor blades extends from one of a plurality of platforms. Each of the plurality of platforms is secured to the attachment slot by an inwardly extending root. A locking spacer assembly is disposed in a space between at least two of the plurality of platforms. The locking spacer assembly comprises a first end piece that is configured to fit into the space between the platforms. The first end piece includes a platform portion and a root portion. The root portion defines a first projection having a profile that is adapted to project into a recess portion of the attachment slot. The platform portion and the root portion define a first inner surface that is angled with respect to a radially extending plane that is perpendicular to an axial centerline of the locking spacer assembly.

A second end piece is configured to fit between the first inner surface and a sidewall portion of the attachment slot. The second end piece includes a platform portion and a root portion. The root portion defines a second projection having a profile that is adapted to project into a recess portion of the attachment slot. The platform portion and the root portion define a second inner surface that is angled with respect to a radially extending plane that is perpendicular to an axial centerline of the locking spacer assembly. The second inner surface is configured to mate with the first inner surface. A borehole extends through the platform portion of the first end piece and the root portion of the second end piece and a fastener extends through the borehole. One end of the fastener is configured to engage with the root portion of the second end piece.

Another embodiment of the present invention is a turbomachine. The turbomachine includes a compressor, a combustor and a turbine. At least one of the compressor or the turbine comprises a rotor disk having forward and aft posts. The forward and aft posts at least partially define a continuous circumferentially extending attachment slot. The turbomachine further includes a plurality of rotor blades. Each of the rotor blades extends from a corresponding one platform of a plurality of platforms. Each of the plurality of platforms is secured to the attachment slot by an inwardly extending root. A locking spacer assembly is disposed in a space between at least two of the plurality of platforms. The locking spacer assembly comprises a first end piece that is configured to fit into the space between the platforms. The first end piece includes a platform portion and a root portion. The root portion defines a first projection having a profile that is adapted to project into a recess portion of the attachment slot.

The platform portion and the root portion define a first inner surface that is angled with respect to a radially extending plane that is perpendicular to an axial centerline of the locking spacer assembly. A second end piece is configured to fit between the first inner surface and a sidewall portion of the attachment slot. The second end piece includes a platform portion and a root portion. The root portion defines a second projection having a profile that is adapted to project into a recess portion of the attachment slot. The platform portion and the root portion define a second inner surface that is angled with respect to a radially extending plane that is perpendicular to an axial centerline of the locking spacer assembly. The second inner surface is configured to mate with the first inner surface. A borehole extends through the platform portion of the first end piece and the root portion of the second end piece and a fastener extends through the borehole. One end of the fastener is configured to engage with the root portion of the second end piece.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
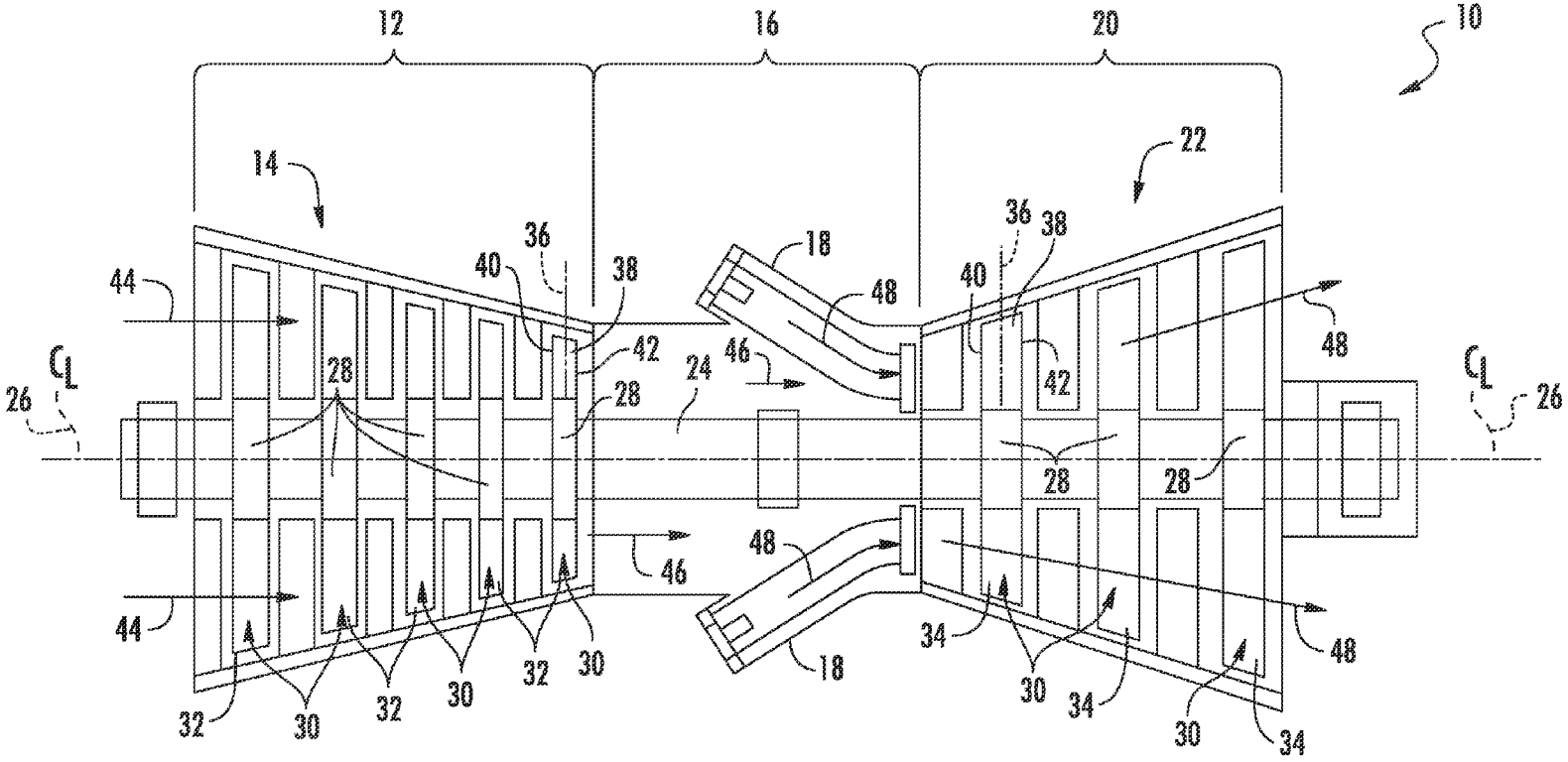
FIG. 1 (PRIOR ART)
FIG. 1 is a functional diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

As used herein, the terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction in a plane that is substantially perpendicular to an axial centerline of a particular component, and the term "axially" refers to the relative direction in a plane that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Although exemplary embodiments of the present invention will be described generally in the context of a gas turbine for purposes of illustration, one of ordinary skill in the art will readily appreciate that embodiments of the present invention may be applied to any turbomachine having a shaft and rotating blades coupled to the shaft such as a steam turbine or the like, and are not limited to a gas turbine unless specifically recited in the claims.

Referring now to the drawings, wherein identical numerals indicate the same elements throughout the figures, FIG. 1 provides a functional diagram of one embodiment of a turbomachine, in this case an exemplary gas turbine 10 which may incorporate various embodiments of the present invention. It should be understood that the present disclosure is not limited to gas turbines, and rather that steam turbines or any other suitable turbomachines are within the scope and spirit of the present disclosure. As shown, the gas turbine 10 generally includes a compressor section 12 including a compressor 14 disposed at an upstream end of the gas turbine 10, a combustion section 16 having at least one combustor 18 downstream from the compressor 14, and a turbine section 20 including a turbine 22 that is downstream from the combustion section 14. A shaft 24 extends along an axial centerline 26 of the gas turbine 10 at least partially through the compressor 14 and/or the turbine 22. In particular configurations, the shaft 24 may comprise of a plurality of individual shafts.

Multiple rotor wheels or disks 28 are disposed coaxially along the shaft 24 within the compressor 14 and/or the turbine 22. Each rotor disk 28 is configured to receive a plurality of radially extending rotor blades 30 that are circumferentially spaced around and removably fixed to the rotor disk 28. The rotor blades 30 may be configured for use within the compressor 14 such as a compressor rotor blade 32 or for use within the turbine 22 such as a turbine bucket or turbine rotor blade 34. Each blade 30 has a longitudinal centerline axis 36 and includes an airfoil portion 38 having a leading edge 40 and a trailing edge 42.

In operation, a working fluid 44 such as air is routed into the compressor 14 where it is progressively compressed in part by the compressor rotor blades 32 as it is routed towards the combustion section 16. A compressed working fluid 46 flows from the compressor 14 and is supplied to the combustion section 16. The compressed working fluid 46 is distributed to each of the combustors 18 where it is mixed with a fuel to provide a combustible mixture. The combustible mixture is burned to produce combustion gases 48 at a relatively high temperature and high velocity. The combustion gases 48 are routed through the turbine 22 where thermal and kinetic energy is transferred to the turbine rotor blades 34, thereby causing the shaft 24 to rotate. In particular applications, the shaft 24 is coupled to a generator (not shown) to produce electricity.

Figure 2:
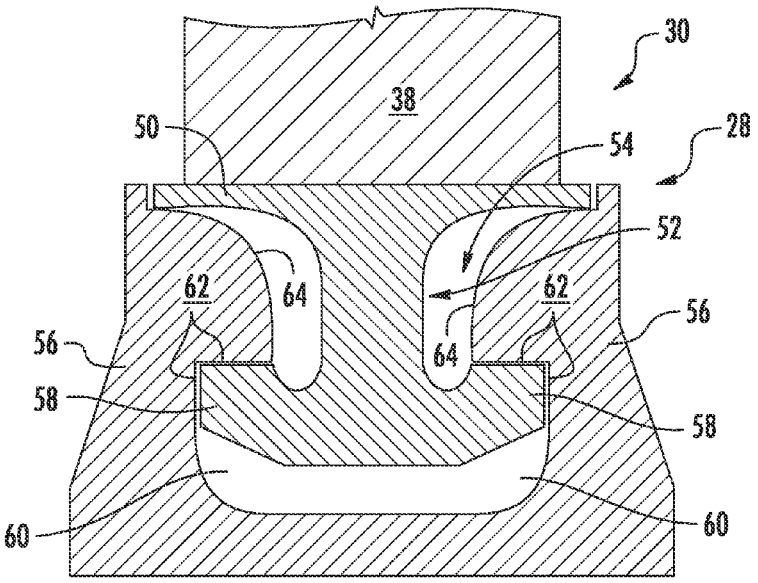
FIG. 2 is a partial sectional view of an embodiment of a root and attachment slot configuration for circumferential entry rotor blades.

FIG. 2 is an enlarged cross section view of a portion of an exemplary rotor disk 28 including an exemplary rotor blade 30 having a T-type root and attachment slot configuration. As shown in FIG. 2, each rotor blade 30 also may include a platform 50 that provides a portion of a radially inner boundary for airflow, combustion gas flow or other fluid flow such as steam over the airfoils 38 during operation of the gas turbine 10. In addition, each rotor blade 30 includes an integral root portion 52 that extends radially inward from the platform 50. The root portion 52 slides into and along a circumferentially extending attachment slot 54 at least partially defined by forward and aft hoop or post components 56 of the rotor disk 28, as is generally known in the art. In the alternative, the circumferentially extending attachment slot 54 may be machined, cast or otherwise defined by the rotor disk 28.

The root portion 52 may include protrusions 58 that are received into lateral recesses 60 defined within the attachment slot 54 and at least partially defined by recessed wall portions 62 of the post components 56. The forward and aft post components 56 and/or the rotor disk 28 may further define sidewall portions 64 of the attachment slot 54. It should be readily appreciated that the configuration of the root portion 52 and attachment slot 54 provided in FIG. 2 is for illustrative purposes only, and that the root and slot configuration may vary widely within the scope and spirit of the present subject matter.

Figure 3:
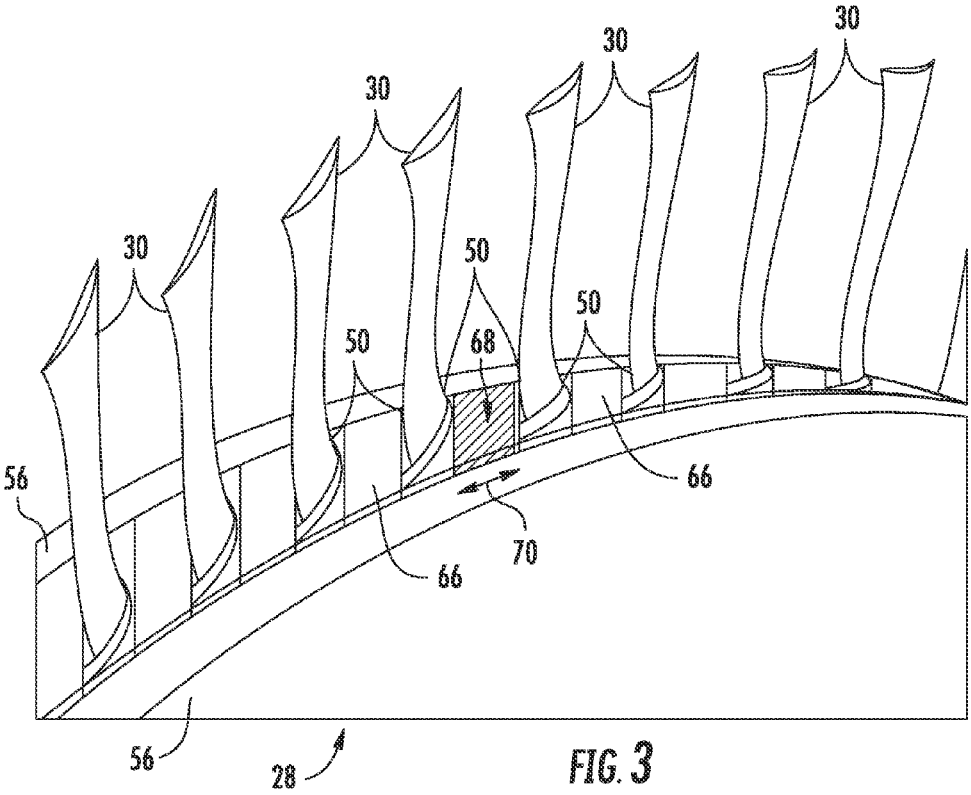
FIG. 3 is a partial perspective view of an exemplary rotor disk including final or load-in spaces into which a locking spacer assembly may be inserted.

FIG. 3 is a partial perspective view of a portion of an exemplary rotor disk 28, and particularly illustrates a plurality of the rotor blades 30 configured in an attachment slot 54 (FIG. 2) between the forward and aft post components 56 of the rotor disk 28. As shown in FIGS. 2 and 3, each of the rotor blades 30 includes a platform 50. As shown in FIG. 3, conventional spacers 64 are disposed between the platforms 50 of adjacent rotor blades 30, as is generally known in the art.

Figure 4:
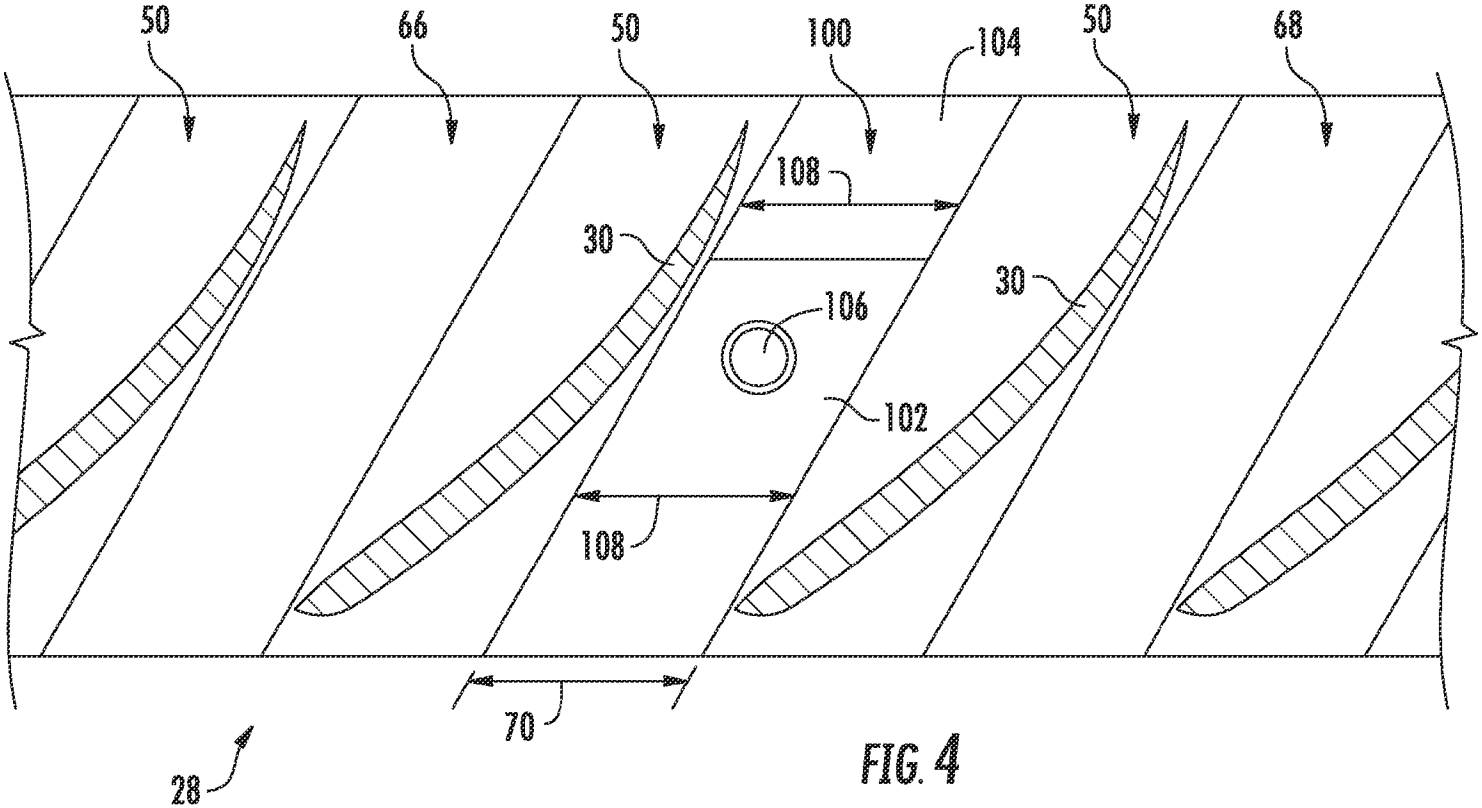
FIG. 4 is a top view of a portion of the rotor disk as shown in FIG. 3, according to one embodiment of the present invention.

FIG. 4 is a top view of a portion of the rotor disk 28 as shown in FIG. 3, according to one embodiment of the present invention. As shown in FIG. 3, one or more final or load-in spaces 68, having a circumferential width 70, are defined between adjacent rotor blade 30 platforms 50. The final or load-in spaces 68 are generally used to insert the rotor blades 30 into the attachment slot 54 during assembly and/or disassembly of the rotor blades 30 to the rotor disk 28. In particular embodiments, as shown in FIG. 4, the final or load-in spaces 68 can be filled by various embodiments of a locking spacer assembly 100 which is described in greater detail below.

It should be appreciated that in particular embodiments, the locking spacer assembly 100 can be used to fill final spaces 68 between platforms 50 of adjacent rotor blades 30 including the compressor rotor blades 32 located within the compressor 14 and/or the turbine rotor blades 34 located within the turbine 22. As such, the locking spacer assembly 100 will be generally described below as being installed between platforms 50 of adjacent rotor blades 30, wherein the platforms 50 may be part of a compressor rotor blade 32 or a turbine rotor blade 34 so as to fully encompass both applications.

Figure 5:
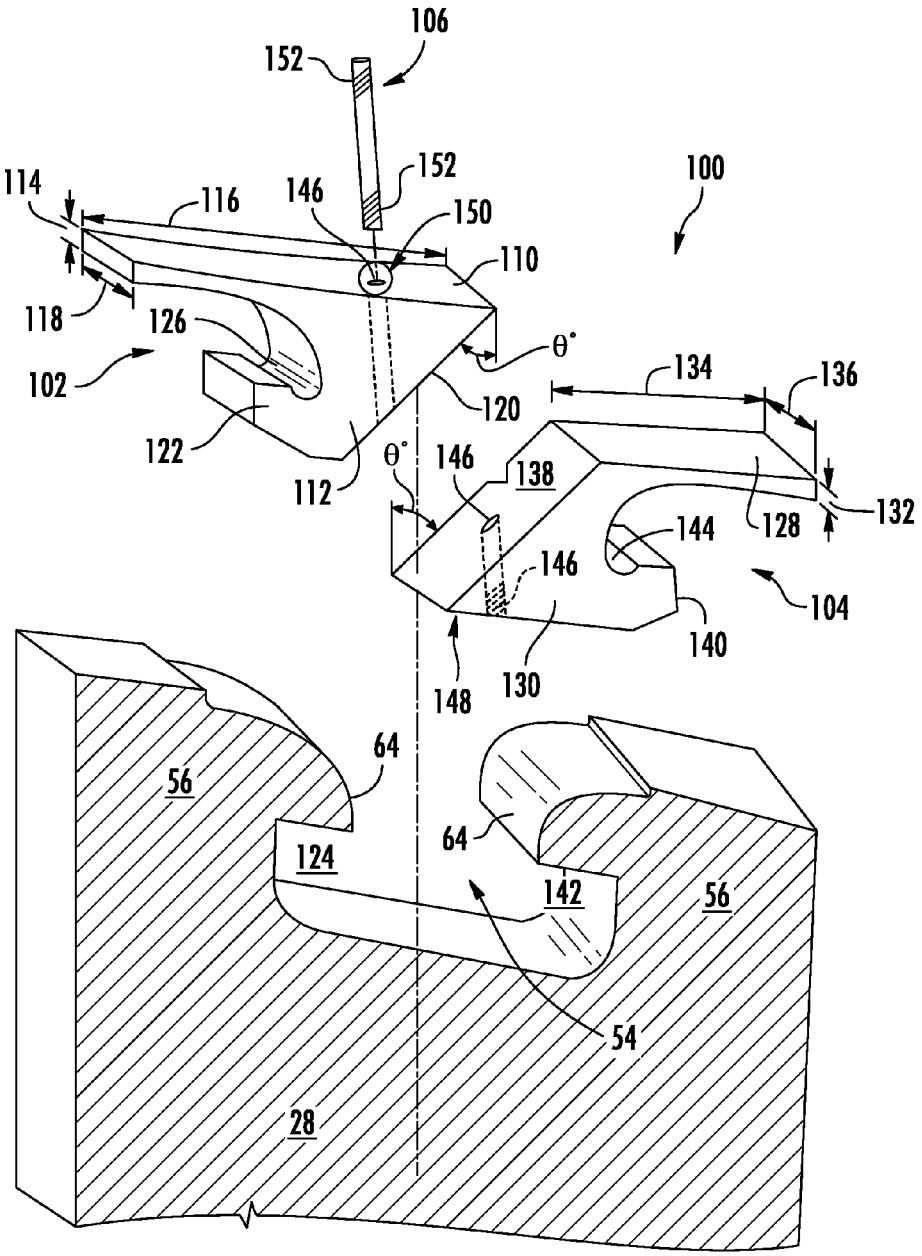
FIG. 5 is a is an exploded view of the components of an embodiment of the locking spacer assembly in accordance with various aspects of the present invention.

FIG. 5 is an exploded view of the components of a locking spacer assembly 100 herein referred to as "assembly 100" according to one embodiment of the present invention. As shown, the assembly 100 includes a first end piece 102, a second end piece 104 and a fastener 106. The first end piece 102 and the second end piece 104 are configured to fit into the final or load-in spaces 68 (FIG. 2) between the platforms 50 of adjacent rotor blades 30 (FIG. 4). The end pieces 102, 104, thus, have any dimensional configuration such that the width, length, thickness, or any other characteristics enables the end pieces 102, 104 to be inserted between the platforms 50. For example, the end pieces 102, 104 may generally have a circumferential width 108 (FIG. 4) in order to fit snugly between the platforms 50 of adjacent airfoils or rotor blades 30.

As shown in FIG. 5, the first end piece 102 comprises a platform portion 110 and a root portion 112. The platform portion 110 generally has a radial height 114, an axial length 116 and a circumferential width 118. The root portion 112 extends radially inwardly from the platform portion 110. The platform portion 110 and the root portion 112 define a first inner surface 120. The first inner surface 120 is angled at an angle θ with respect to a radially extending plane that is perpendicular to an axial plane and/or axial centerline that extends through the locker spacer assembly 100 and/or the first end piece 102. In particular embodiments, the angle θ the first inner surface 120 is greater than zero degrees and less than ninety degrees.

The root portion 112 defines a first projection 122. The first projection 122 has an outer profile that is adapted to project into a first lateral recess 124 of the attachment slot 54. For example, the first projection 122 may have a top portion that is substantially curved to mirror the curve of the post components 56. Moreover, the first projection 122 may include a bottom portion that extends outwardly at the corner formed between the post components 56 and the first lateral recess 124 so as to project into the illustrated t-type attachment slot 54. It should be readily appreciated that the first projection 122 can have any desired outer profile and need not have the particular outer profile illustrated in FIG. 5. The outer profile of the first projection 122 will depend in large part on the particular shape and configuration of the attachment slot 54.

In particular embodiments, an arcuate groove 126 or other stress relief feature such as a blend or fillet is defined by the first end piece 102 proximate to a location where the first projection 122 is defined or extends generally axially outwardly from the root portion 112 of the first end piece 102. The arcuate groove 126 may be included to provide a point of low stress or a location for stress relief on the first end piece 102. As later illustrated, the arcuate groove 126 may be located on the root portion 112 at a corner formed between the forward post component 56 and the first lateral recess 124.

The second end piece 104 is configured to fit between the first inner surface 120 of the first end piece 102 and one of the sidewall portions 64 of the attachment slot 54. As shown in FIG. 5, the second end piece 104 comprises a platform portion 128 and a root portion 130. The platform portion 128 generally has a radial height 132, an axial length 134 and a circumferential width 136. The root portion 130 extends radially inwardly from the platform portion 128. The platform portion 128 and the root portion 130 define a second inner surface 138.

The second inner surface 138 is configured to mate with the first inner surface 120. For example, the first and second inner surfaces 120, 138 may be flat or congruently curved or slotted. The second inner surface 138 is angled with respect to a radially extending plane that is perpendicular to an axial plane that extends through the locker spacer assembly 100 and/or the second end piece 104. In particular embodiments, the angle of the second inner surface 138 is greater than zero degrees and less than ninety degrees. In one embodiment, the angle of the first inner surface 120 and the angle of the second inner surface 138 are substantially similar. In one embodiment, the angle of the first inner surface 120 and the angle of the second inner surface 138 are congruent.

The root portion 130 defines a second projection 140. The second projection 140 has an outer profile that is adapted to project into a second lateral recess 142 of the attachment slot 54. For example, the second projection 140 may have a top portion that is substantially curved to mirror the curve of the post components 56. Moreover, the second projection 140 may include a bottom portion that extends outwardly at the corner formed between the post components 56 and the second lateral recess 142 so as to project into the illustrated t-type attachment slot 54. It should be readily appreciated that the second projection 140 can have any desired profile and need not have the particular profile illustrated in FIG. 5. The profile of the second projection 140 will depend in large part on the particular shape and configuration of the attachment slot 54.

In particular embodiments, an arcuate groove 144 or other stress relief feature such as a blend or fillet is defined by the second end piece 104 proximate to a location where the second projection 140 is defined or extends generally axially outwardly from the root portion 130 of the second end piece 104. The arcuate groove 144 may be included to provide a point of low stress or a location for stress relief on the second end piece 104. As illustrated, the arcuate groove 144 may be located on the root portion 130 at corners formed between the aft post component 56 and the second lateral recess 142.

It should be readily appreciated that the second projection 140 can have any desired profile and need not have the particular profile illustrated in FIG. 5. The profile of the second projection 140 will depend in large part on the particular shape and configuration of the attachment slot 54.

As shown in FIG. 5, a borehole 146 extends continuously through the first end piece 102 and the second end piece 104. The borehole 146 may be at least partially defined by the first and second end pieces 102, 104. When the locking spacer assembly is installed, the borehole 146 extends continuously through the first end piece 102 and the second end piece 104. In one embodiment, the borehole 146 extends through the platform portion 110 of the first end piece 102 and the root portion 130 of the second end piece 104. The borehole 146 extends through a bottom wall 148 defined by the root portion 130 of the second end piece 104. In one embodiment, the borehole 146 extends generally radially through the first and second end pieces 102, 104.

In particular embodiments, the borehole 146 may be threaded in at least one of the first end piece 102 or the second end piece 104. In one embodiment, the borehole 146 includes a counter bore 150 or step feature defined within the platform portion 110 of the first end piece 102.

The fastener 106 may include any fastener such as a screw, bolt, pin or the like that extends through the borehole 146. The fastener 106 may include threads 152 disposed along the shank of the fastener 106. The threads 152 may be complementary to the threads defined within the first and/or second end pieces 102, 104.

Figure 6:
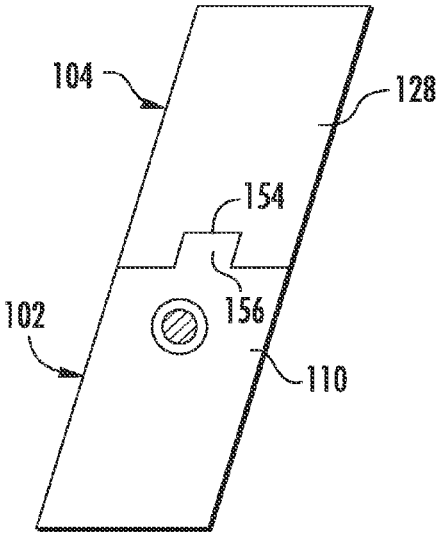
FIG. 6 is a top view of the locking spacer assembly as shown in FIG. 5, according to one embodiment of the present invention.
Figure 7:
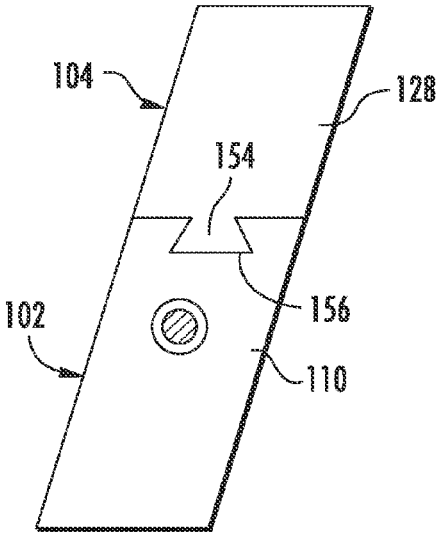
FIG. 7 is a top view of the locking spacer assembly as shown in FIG. 5, according to one embodiment of the present invention.
Figure 8:
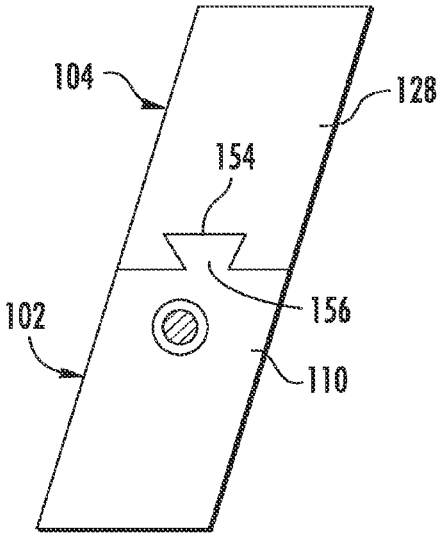
FIG. 8 is a top view of the locking spacer assembly as shown in FIG. 5, according to one embodiment of the present invention.

FIG. 6, FIG. 7 and FIG. 8 provide top views of the locker spacer assembly 100 as shown in FIG. 5, according to various embodiments of the present invention. As shown in FIGS. 6, and 8, a recess 154 may be formed on the platform portion 110 of the first end piece 102. In the alternative, as shown in FIG. 7, the recess 154 may be formed on the platform portion 128 of the second end piece 104. The recess 154 may be configured to receive a complimentary collar 156 formed on the platform portion 110 of the first end piece 102 or on the platform portion 128 of the second end piece 104 when the first end piece 102 and the second end piece 104 are installed into the attachment slot 54. For example, the recess 154 and the collar 156 may be rectangular, trapezoidal, arcuate or any shape so as to create an interlocking action between the first and second end pieces 102, 104.

Figure 9:
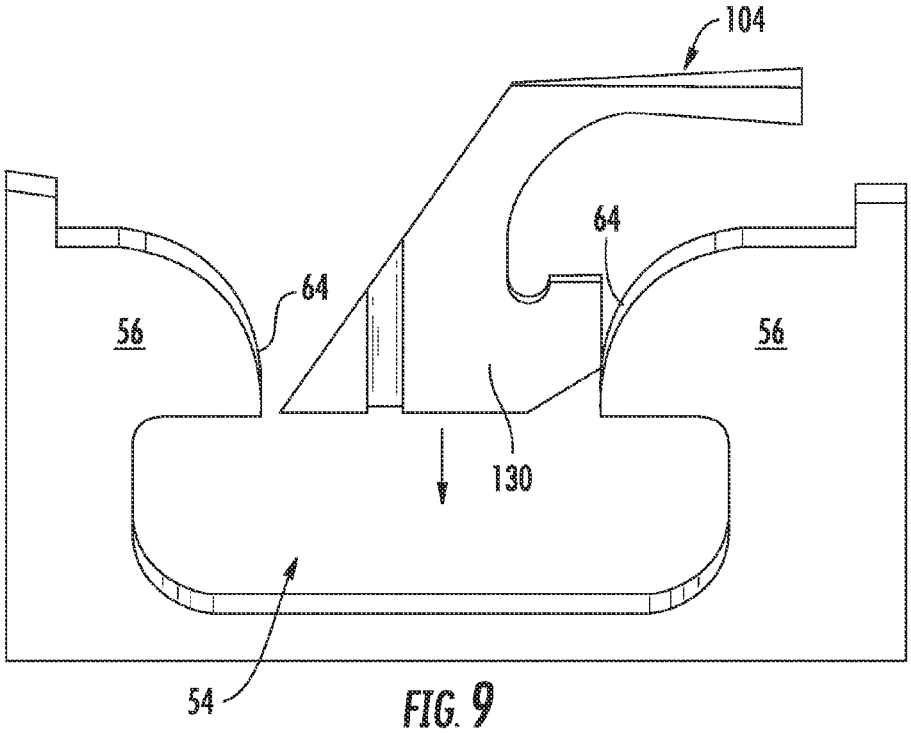
FIG. 9, FIG. 10, FIG. 11, FIG. 12, FIG. 13 and FIG. 14 are sequential assembly views of a locking spacer assembly according to one embodiment of the present invention.
Figure 10:
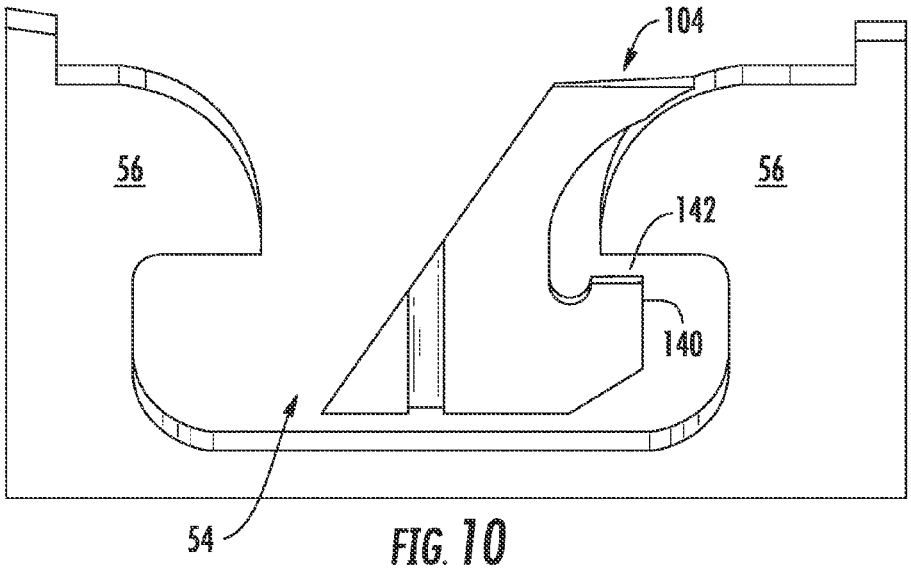
Figure 11:
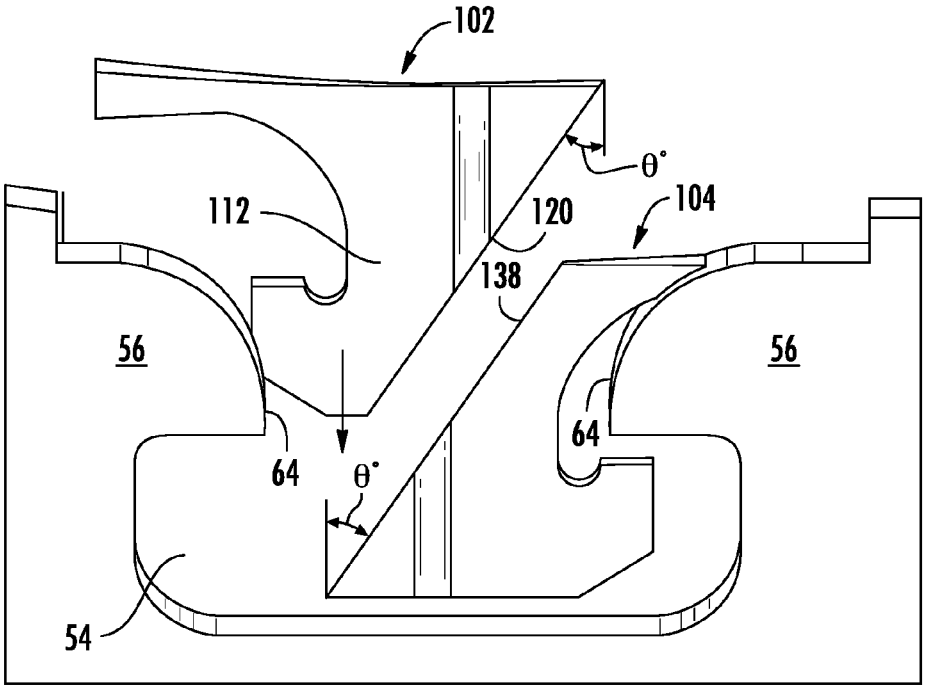
Figure 12:
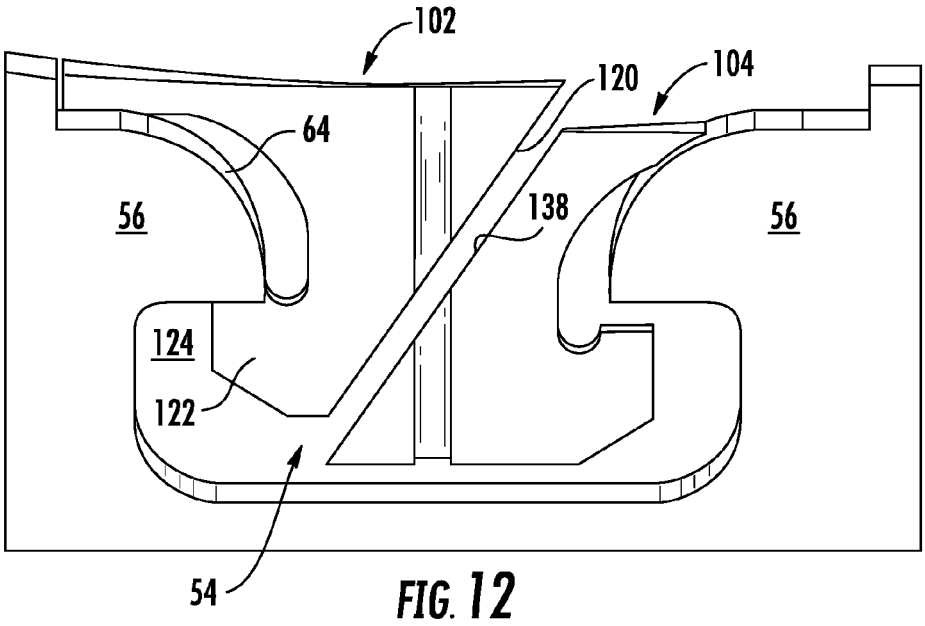

FIG. 9, FIG. 10, FIG. 11, FIG. 12, FIG. 13 and FIG. 14 are sequential assembly views of a locking spacer assembly 100 according to one embodiment of the present invention. As shown in FIG. 9, the root portion 130 of the second end piece 104 is lowered into the attachment slot 54 between the opposing sidewall portions 64. As shown in FIG. 10, the second projection 140 is positioned within the second lateral recess 142. As shown in FIG. 11, the root portion 112 of first end piece 102 is lowered into the attachment slot 54 adjacent to the second end piece 104 such that the first inner surface 120 and the second inner surface 138 face one another. As show in FIGS. 11 and 12, the substantially similar or congruent angles of the first and second inner surfaces 120, 136 allow the first end piece 102 to be positioned into the attachment slot 54 and the first projection 122 to be inserted into the first lateral recess 124 with the second end piece 104 being in position within the attachment slot 54.

Figure 13:
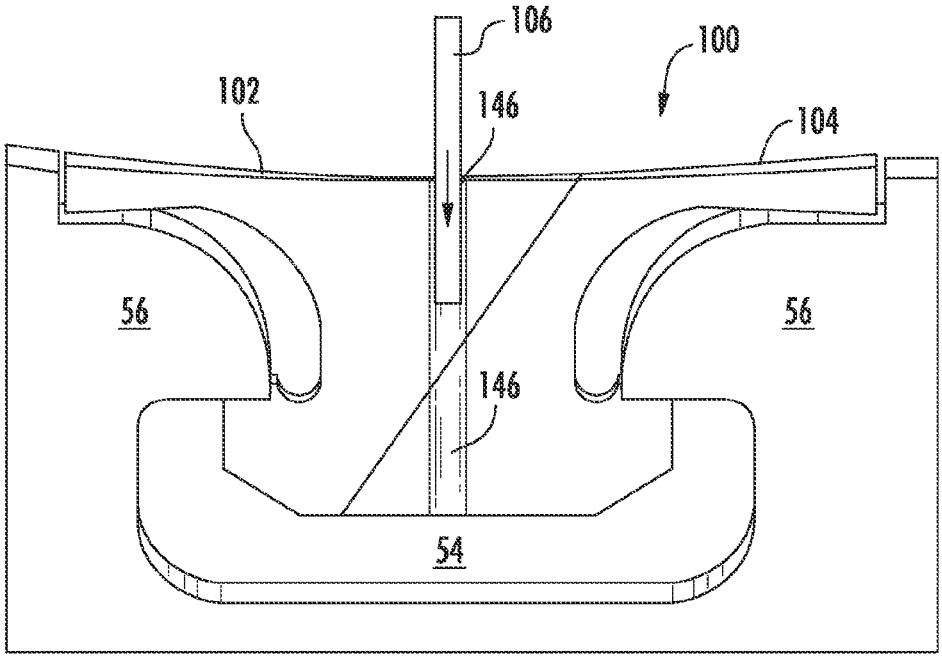
Figure 14:
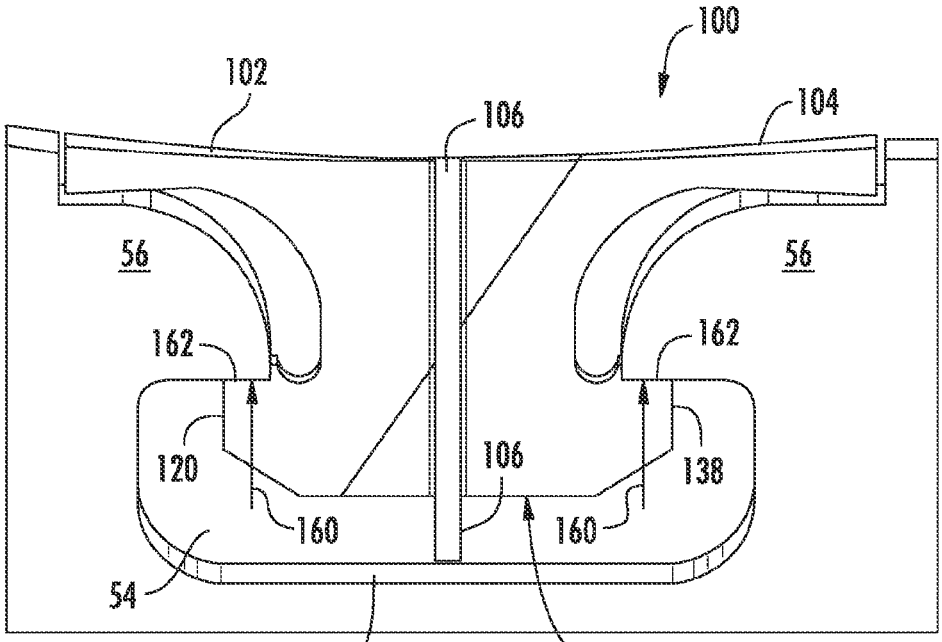

As shown in FIG. 13, the fastener 106 is then inserted into the borehole 146 and turned, threaded, hammered or otherwise translated through the borehole 146 until the fastener 106 engages with the second end piece 102, thereby locking the locking spacer assembly into position and securing the adjacent rotor blades 30 to the rotor disk 28. In a particular embodiment, as shown in FIG. 14, the fastener 106 extends through the bottom wall 148 of the second end piece 104.

Figure 15:
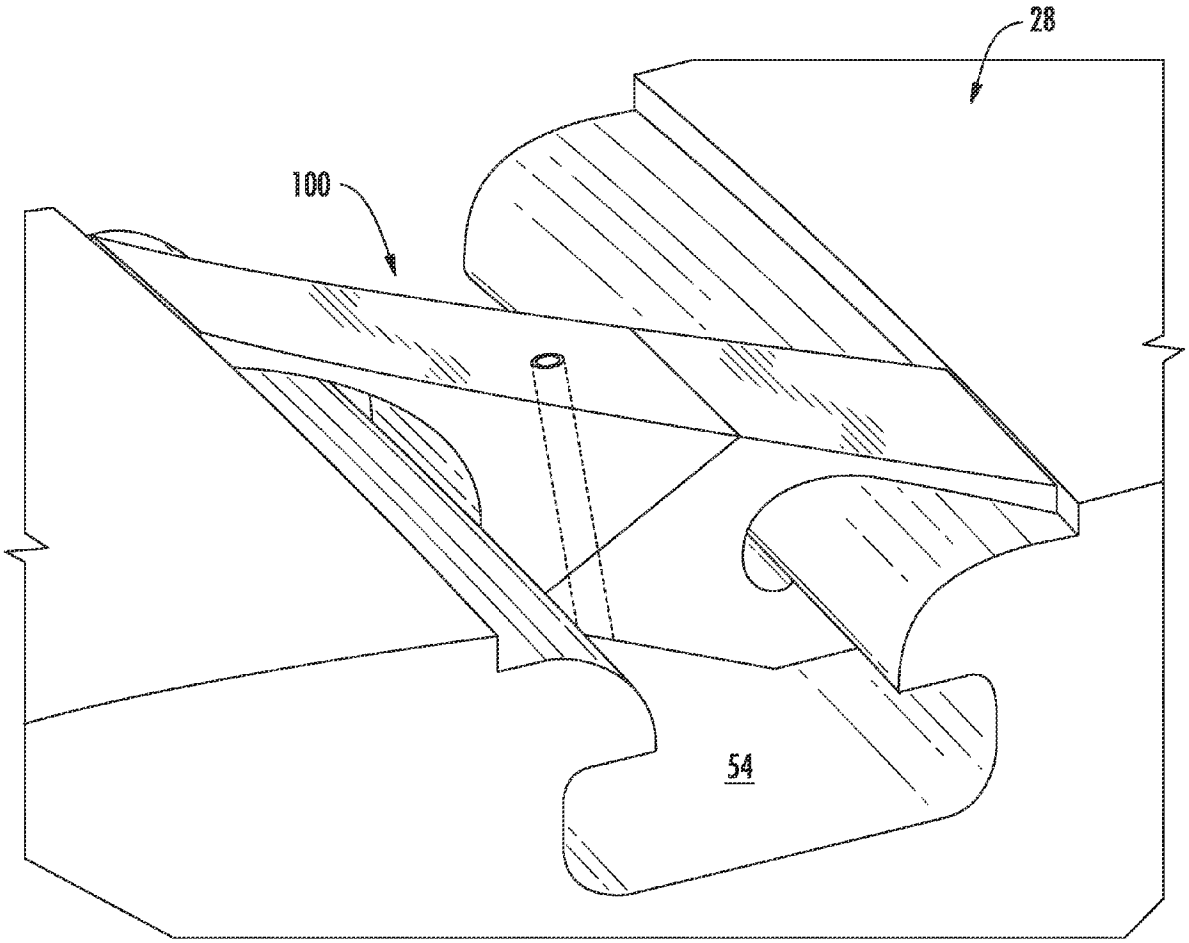
FIG. 15 is a partial perspective view of a portion of a rotor disk including a locking spacer assembly according to one embodiment of the present invention.

The fastener 106 may engage a bottom wall portion 158 of the attachment slot 54, thus creating an upwardly or radially acting force 160 between the first and second projections 120, 130 and upper wall portions 162 of the first and second lateral recesses 124, 140, thereby locking the locking spacer assembly into position and securing the adjacent rotor blades 30 to the rotor disk 28. It should be obvious to one of ordinary skill that disassembly of the locker spacer assembly 100 may be achieved by simply reversing the assembly steps described herein. FIG. 15 is a partial perspective view of a portion of a rotor disk 28 including the locking spacer assembly 100 installed into the attachment slot 54.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A locking spacer assembly for insertion into a circumferential attachment slot between platforms of adjacent rotor blades, comprising: a first end piece configured to fit into a space between platforms of the adjacent rotor blades, the first end piece comprising a platform portion and a root portion, the root portion defining a first projection having a profile adapted to project into a recess portion of the attachment slot, the platform portion and the root portion defining a first inner surface, wherein the first inner surface is oriented entirely at an acute angle with respect to a radially extending plane; a second end piece configured to fit between the first inner surface and a sidewall portion of the attachment slot, the second end piece having a platform portion and a root portion, the root portion defining a second projection having a profile adapted to project into a recess portion of the attachment slot, the platform portion and the root portion defining a second inner surface oriented entirely at an acute angle with respect to the radially extending plane and configured to mate with the first inner surface; a borehole that extends through the platform portion and the first inner surface of the first end piece and the root portion and the second inner surface of the second end piece; and a fastener that extends through the borehole, wherein one end of the fastener is configured to engage with the root portion of the second end piece, wherein the fastener is completely circumscribed by the first end piece, and wherein the fastener is completely circumscribed by the first end piece.

2. The locking spacer assembly as in claim 1, wherein the first inner surface acute angle and the second inner surface acute angle are congruent.

3. The locking spacer assembly as in claim 1, wherein a portion of the borehole extending through the root portion of the second end piece is threaded.

4. The locking spacer assembly as in claim 1, wherein the borehole extends radially through the first and second end pieces.

5. The locking spacer assembly as in claim 1, wherein at least a portion of the fastener is threaded.

6. The locking spacer assembly as in claim 1, Wherein a head portion of the fastener is recessed into the first end piece.

7. The locking spacer assembly as in claim 1, wherein the fastener comprises one of a set screw or a press fit pin.

8. A rotor assembly, comprising: a rotor disk comprising forward and aft posts defining a continuous circumferentially extending attachment slot; a plurality of rotor blades, each of the plurality of rotor blades extending from one of a plurality of platforms, wherein each of the plurality of platforms is secured to the attachment slot by an inwardly extending root; and a locking spacer assembly disposed in a space between two adjacent platforms of the plurality of platforms, the locking spacer assembly comprising: a first end piece configured to fit into the space between the platforms, the first end piece comprising a platform portion and a root portion, the root portion defining a first projection having a profile adapted to project into a recess portion of the attachment slot, the platform portion and the root portion defining a first inner surface, wherein the first inner surface is oriented entirely at an acute angle with respect to a radially extending plane; a second end piece configured to fit between the first inner surface and a sidewall portion of the attachment slot, the second end piece having a platform portion and a root portion, the root portion defining a second projection having a profile adapted to project into a recess portion of the attachment slot, the platform portion and the root portion defining a second inner surface oriented entirely at an acute angle with respect the radially extending plane and configured to mate with the first inner surface; a borehole that extends through the platform portion and the first inner surface of the first end piece and the root portion and the second inner surface of the second end piece; and a fastener that extends through the borehole, wherein one end of the fastener is configured to engage with the root portion of the second end piece, and wherein the fastener is completely circumscribed by the first end piece.

9. The rotor assembly as in claim 8, wherein the first inner surface acute angle of the first end piece and the second inner surface acute angle of the second end piece are congruent.

10. The rotor assembly as in claim 8, wherein at least a portion of the borehole is threaded.

11. The rotor assembly as in claim 8, wherein the borehole extends radially through the first and second end pieces.

12. The rotor assembly as in claim 8, wherein at least a portion of the fastener is threaded.

13. The rotor assembly as in claim 8, wherein the fastener includes a head portion and the head portion is recessed into the platform portion of the first end piece.

14. The rotor assembly as in claim 8, wherein the rotor disk includes a half-pitch cutout defined in at least one of the forward and aft posts for insertion of the first and second end pieces into the attachment slot.

15. A turbomachine, comprising: a compressor; a combustor; a turbine; and wherein at least one of the compressor or the turbine comprises: a rotor disk comprising forward and aft posts defining a continuous circumferentially extending attachment slot; a plurality of rotor blades, each of the plurality of rotor blades extending from one of a plurality of platforms, wherein each of the plurality of platforms is secured to the attachment slot by an inwardly extending root: and a locking spacer assembly disposed in a space between at least two of the plurality of platforms, the locking spacer assembly comprising: a first end piece configured to fit into the space between platforms of the adjacent rotor blades, the first end piece comprising a platform portion and a root portion, the root portion defining a first projection having a profile adapted to project into a recess portion of the attachment slot, the platform portion and the root portion defining a first inner surface, wherein the first inner surface is oriented entirely at an acute angle with respect to a radially extending plane; a second end piece configured to fit between the first inner surface and a sidewall portion of the attachment slot, the second end piece having a platform portion and a root portion, the root portion defining a second projection having a profile adapted to project into a recess portion of the attachment slot, the platform portion and the root portion defining a second inner surface oriented entirely at an acute angle with respect to the radially extending plane and configured to mate with the first inner surface; a borehole that extends through the platform portion and the first inner surface of the first end piece and the root portion and the second inner surface of the second end piece; and a fastener that extends through the borehole, wherein one end of the fastener is configured to engage with the root portion of the second end piece, and wherein the fastener is completely circumscribed by the first end piece.

16. The turbomachine as in claim 15, herein the first inner surface acute angle of the first end piece and the second inner surface acute angle of the second end piece are congruent.

17. The turbomachine as in claim 15, wherein a portion of the borehole extending through the root portion of the second end piece is threaded.

18. The turbomachine as in claim 15, wherein the borehole extends radially through the first and second end pieces.

19. The turbomachine as in claim 15, wherein at least a portion of the fastener is threaded.

20. The turbomachine as in claim 15, wherein a. head portion of the fastener is recessed into the first end piece.

* * * * *